US010864727B2

(12) United States Patent
Koide et al.

(10) Patent No.: US 10,864,727 B2
(45) Date of Patent: Dec. 15, 2020

(54) LIQUID DISCHARGE HEAD AND LIQUID DISCHARGE APPARATUS PROVIDED WITH THE SAME

(71) Applicant: Brother Kogyo Kabushiki Kaisha, Nagoya (JP)

(72) Inventors: Shohei Koide, Nagoya (JP); Keita Hirai, Nagoya (JP); Keita Sugiura, Toyokawa (JP); Hiroshi Katayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/697,355

(22) Filed: Nov. 27, 2019

(65) Prior Publication Data

US 2020/0238704 A1 Jul. 30, 2020

(30) Foreign Application Priority Data

Jan. 28, 2019 (JP) ..... 2019-012028

(51) Int. Cl.
*B41J 2/14* (2006.01)
*B41J 2/045* (2006.01)
*B41J 2/18* (2006.01)

(52) U.S. Cl.
CPC ..... *B41J 2/14201* (2013.01); *B41J 2/04581* (2013.01); *B41J 2/18* (2013.01); *B41J 2002/14306* (2013.01)

(58) Field of Classification Search
CPC ..... B41J 2/14201; B41J 2/18; B41J 2/04581; B41J 2002/14306
See application file for complete search history.

(56) References Cited

U.S. PATENT DOCUMENTS

2018/0201019 A1 7/2018 Seto et al.
2020/0198348 A1* 6/2020 Tamai ..... B41J 2/14233

FOREIGN PATENT DOCUMENTS

JP 2018-114675 A 7/2018
JP 2018-114713 A 7/2018

* cited by examiner

*Primary Examiner* — Julian D Huffman
(74) *Attorney, Agent, or Firm* — Banner & Witcoff, Ltd.

(57) ABSTRACT

A liquid discharge head includes: individual channels; a supply channel connected to inlets of the individual channels and through which liquid is supplied to the individual channels; and a recovery channel connected to outlets of the induvial channels and through which the liquid is recovered from the individual channels. Each of the induvial channels includes: a nozzle; an upstream-side pressure chamber disposed between the nozzle and the supply channel; a downstream-side pressure chamber disposed between the nozzle and the recovery channel; an upstream-side throttle channel connecting the supply channel and the upstream-side pressure chamber; and a downstream-side throttle channel connecting the recovery channel and the downstream-side pressure chamber. A channel resistance of the upstream-side throttle channel is smaller than a channel resistance of the downstream-side throttle channel.

9 Claims, 6 Drawing Sheets

LIQUID DISCHARGE HEAD AND LIQUID DISCHARGE APPARATUS PROVIDED WITH THE SAME

CROSS REFERENCE TO RELATED APPLICATION

The present application claims priority from Japanese Patent Application No. 2019-012028 filed on Jan. 28, 2019, the disclosure of which is incorporated herein by reference in its entirety.

BACKGROUND

Field of the Invention

The present disclosure relates to a liquid discharge head and a liquid discharge apparatus provided with the liquid discharge head.

Description of the Related Art

There is known a liquid discharge head including: multiple channels (individual channels) that respectively include nozzles; first pressure chambers (upstream-side pressure chambers) and second pressure chambers (lower-side pressure chambers) connected to the respective nozzles; auxiliary channels (upstream-side throttle channels) communicating with the first pressure chambers; auxiliary channels (downstream-side throttle channels) communicating with the second pressure chambers; a supply channel through which ink is supplied to the individual channels; and a recovery channel through which ink is recovered from the individual channels. Ink is discharged from nozzles by driving first piezoelectric elements (upstream-side actuators) that apply pressure to the ink in the first pressure chambers and second piezoelectric elements (downstream-side actuators) that apply pressure to the ink in the second pressure chambers. In the above liquid discharge head, ink flows from the supply channel to the recovery channel via the individual channels. The capacity or volume of the second pressure chamber is smaller than that of the first pressure chamber.

SUMMARY

Air may enter the individual channels thorough nozzles and the like. If air stays in the vicinity of the nozzles of the individual channels, discharge characteristics of the nozzles are affected thereby.

When the liquid flows from the supply channel to the recovery channel via the individual channels like the liquid discharge head as described above, the liquid flow allows the air accumulated in the vicinity of the nozzles to be discharged to the recovery channel. However, if the flow rate of liquid in the vicinity of the nozzles in the individual channels is slow, the air in the vicinity of the nozzles can not be discharged to the recovery channel effectively.

An object of the present disclosure is to provide a liquid discharge head that is capable of effectively discharging air in the vicinity of nozzles to a recovery channel, and a liquid discharge apparatus including the liquid discharge head.

According to an aspect of the present disclosure, there is provided a liquid discharge head, including: a plurality of individual channels; a supply channel connected to inlets of the individual channels and through which liquid is supplied to the individual channels; a recovery channel connected to outlets of the induvial channels and through which the liquid is recovered from the individual channels, wherein each of the induvial channels includes: a nozzle; an upstream-side pressure chamber disposed between the nozzle and the supply channel; a downstream-side pressure chamber disposed between the nozzle and the recovery channel; an upstream-side throttle channel connecting the supply channel and the upstream-side pressure chamber; and a downstream-side throttle channel connecting the recovery channel and the downstream-side pressure chamber, the liquid discharge head further comprising: an upstream-side actuator configured to apply pressure to the liquid in the upstream-side pressure chamber; and a downstream-side actuator configured to apply pressure to the liquid in the downstream-side pressure chamber, wherein a channel resistance of the upstream-side throttle channel is smaller than a channel resistance of the downstream-side throttle channel.

DESCRIPTION OF THE EMBODIMENTS

An embodiment of the present disclosure is explained below.

Figure 1:
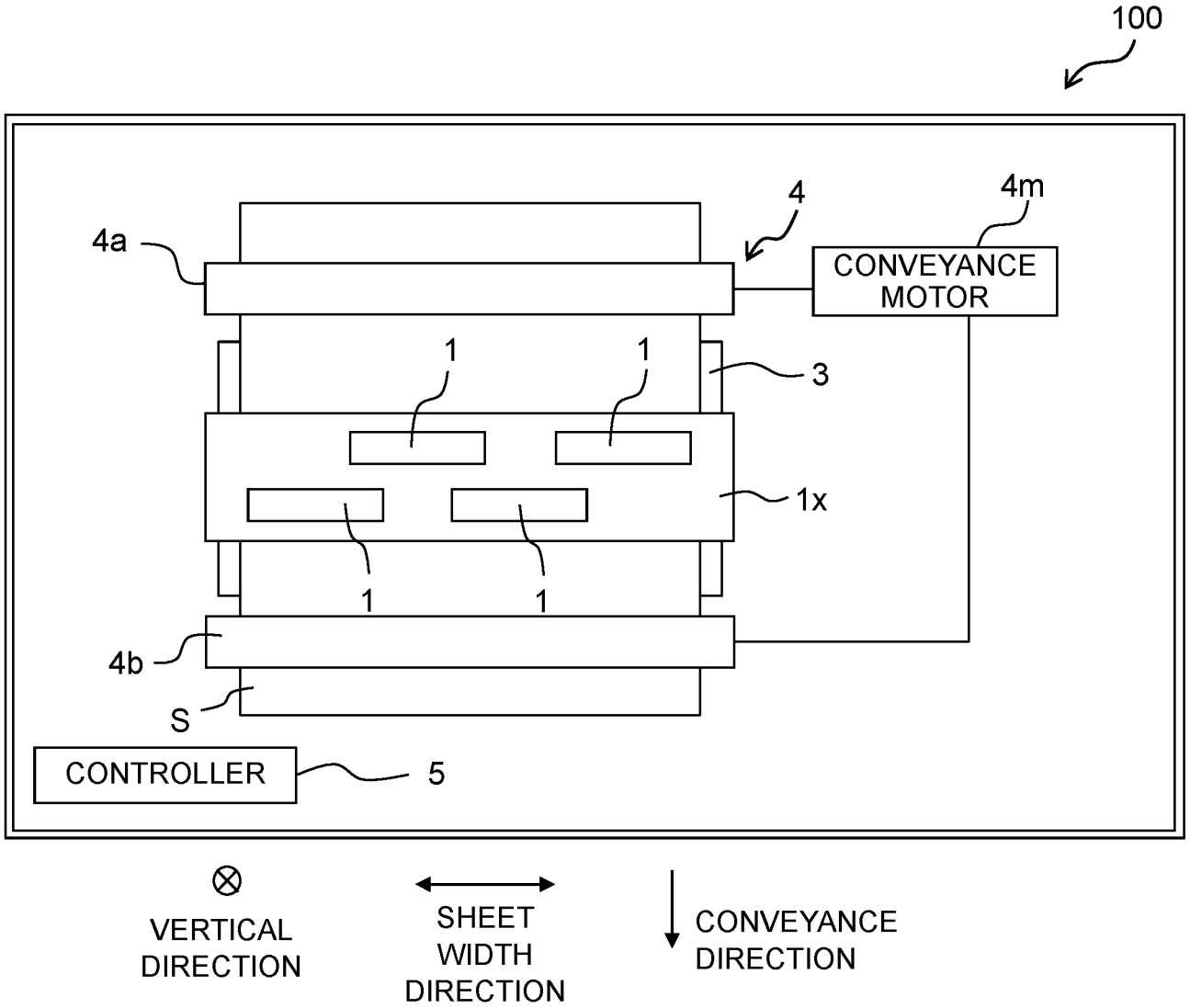
FIG. 1 is a plan view of a printer including heads according to an embodiment of the present disclosure.

As depicted in FIG. 1, a printer 100 (corresponding to a liquid discharge apparatus of the present disclosure) according to this embodiment includes a head unit 1X, a platen 3, a conveyer 4, a controller 5, and the like.

The conveyer 4 includes two conveyance rollers 4*a*, 4*b* arranged in a conveyance direction. Two conveyance rollers 4*a*, 4*b* are connected to a conveyance motor 4*m* via a gear or the like (not depicted). When the controller 5 drives the conveyance motor 4*m*, the conveyance rollers 4*a*, 4*b* rotate to convey a sheet S, which is a recording medium, in the conveyance direction.

The platen 3 is disposed so that the platen 3 is interposed between the two conveyance rollers 4*a* and 4*b* in the conveyance direction. The platen 3 supports the sheet S conveyed by the conveyer 4 from below. The sheet S conveyed by the conveyer 4 passes through the platen 3.

The head unit 1X is disposed to face the platen 3 in a vertical direction. The head unit 1X is long in a sheet width direction. The head unit 1X includes four heads 1 (corresponding to a liquid discharge head of the present disclosure) arranged zigzag in the sheet width direction. The head 1 is driven by a driver IC 1*d* (see FIG. 4). The head 1 discharges ink from nozzles 21 (see FIGS. 2 and 3) formed in its lower surface. The sheet width direction, the conveyance direction, and the vertical direction are orthogonal to each other. The head 1 is described below in detail.

The printer 100 records an image on the sheet S by discharging ink from the nozzles 21 of the four heads 1 while conveying the sheet S by use of the conveyer 4 in the conveyance direction. Namely, the printer 100 is a line-type ink-jet printer in which ink is discharged from the nozzles 21 of the heads 1 on the sheet S with the heads 1 being fixed or secured.

Figure 4:
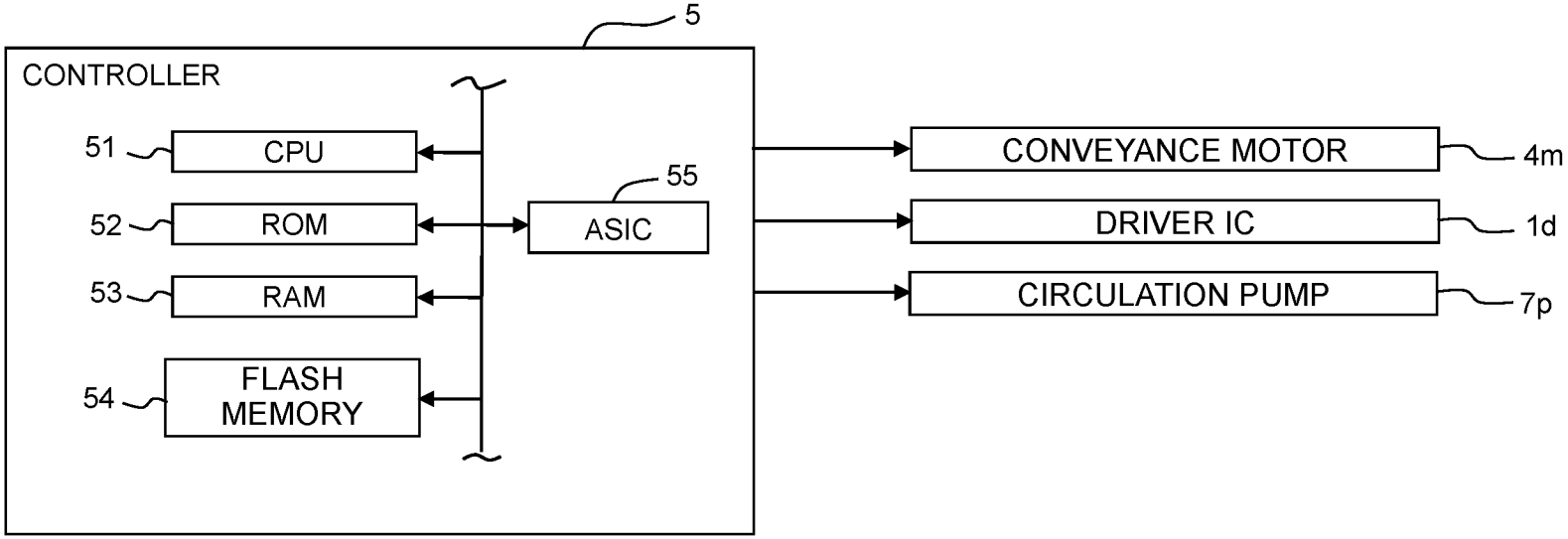
FIG. 4 is a block diagram of an electrical configuration of the printer.

As depicted in FIG. 4, the controller 5 includes a Central Processing Unit (CPU) 51, a Read Only Memory (ROM) 52, a Random Access Memory (RAM) 53, a flash memory 54, an Application Specific Integrated Circuit (ASIC) 55, and the like. The controller 5 controls operations of the conveyance motor 4*m*, the drive IC 1*d*, a circulation pump 7*p*, and the like. For example, the controller 5 controls the driver IC 1*d* and the conveyance motor 4*m* of each head 1 based on a recording instruction (including image data) input from an external apparatus, such as a PC to execute recording processing in which an image is recorded on the sheet S.

Figure 2:
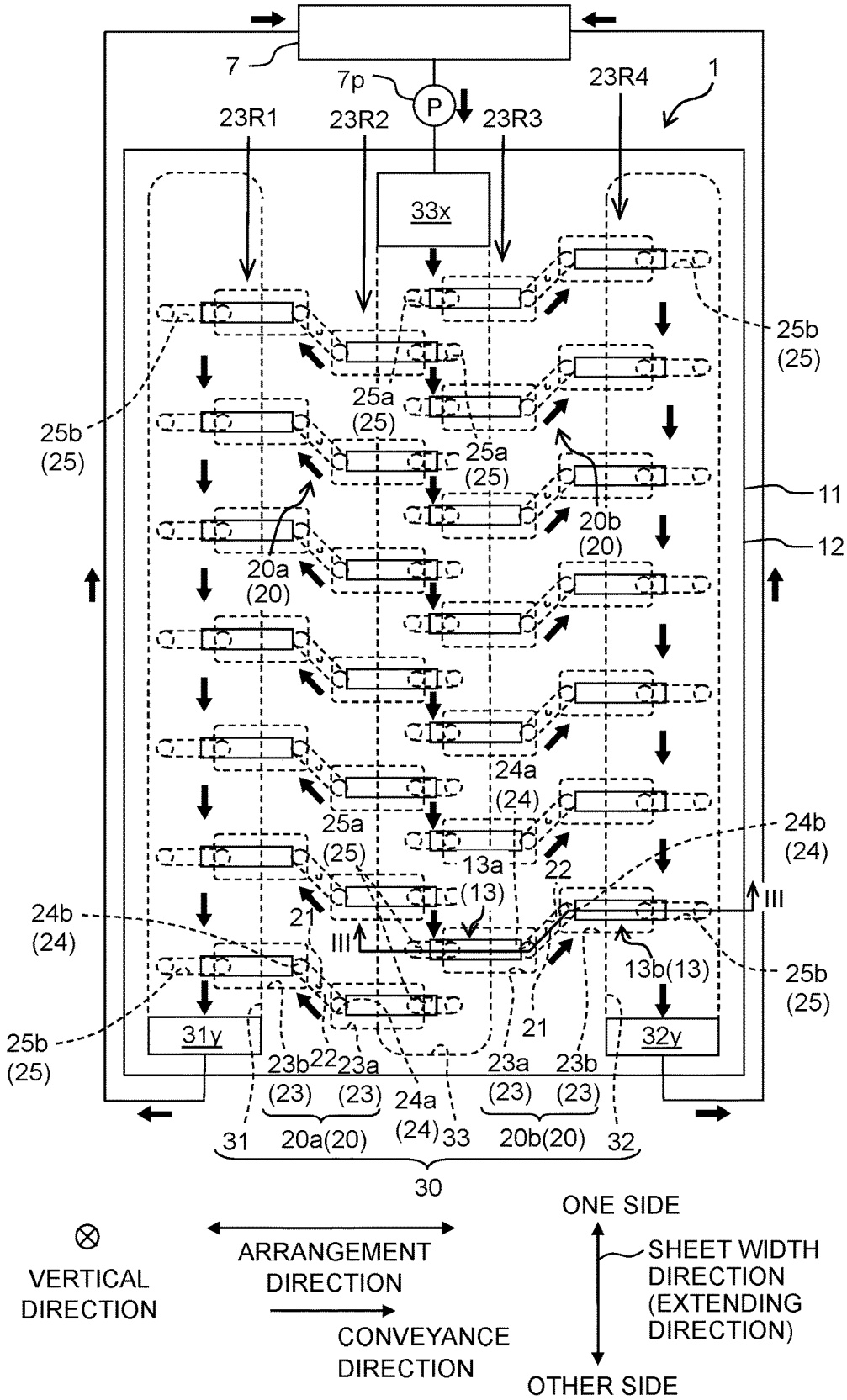
FIG. 2 is a plan view of the head in FIG. 1.
Figure 3:
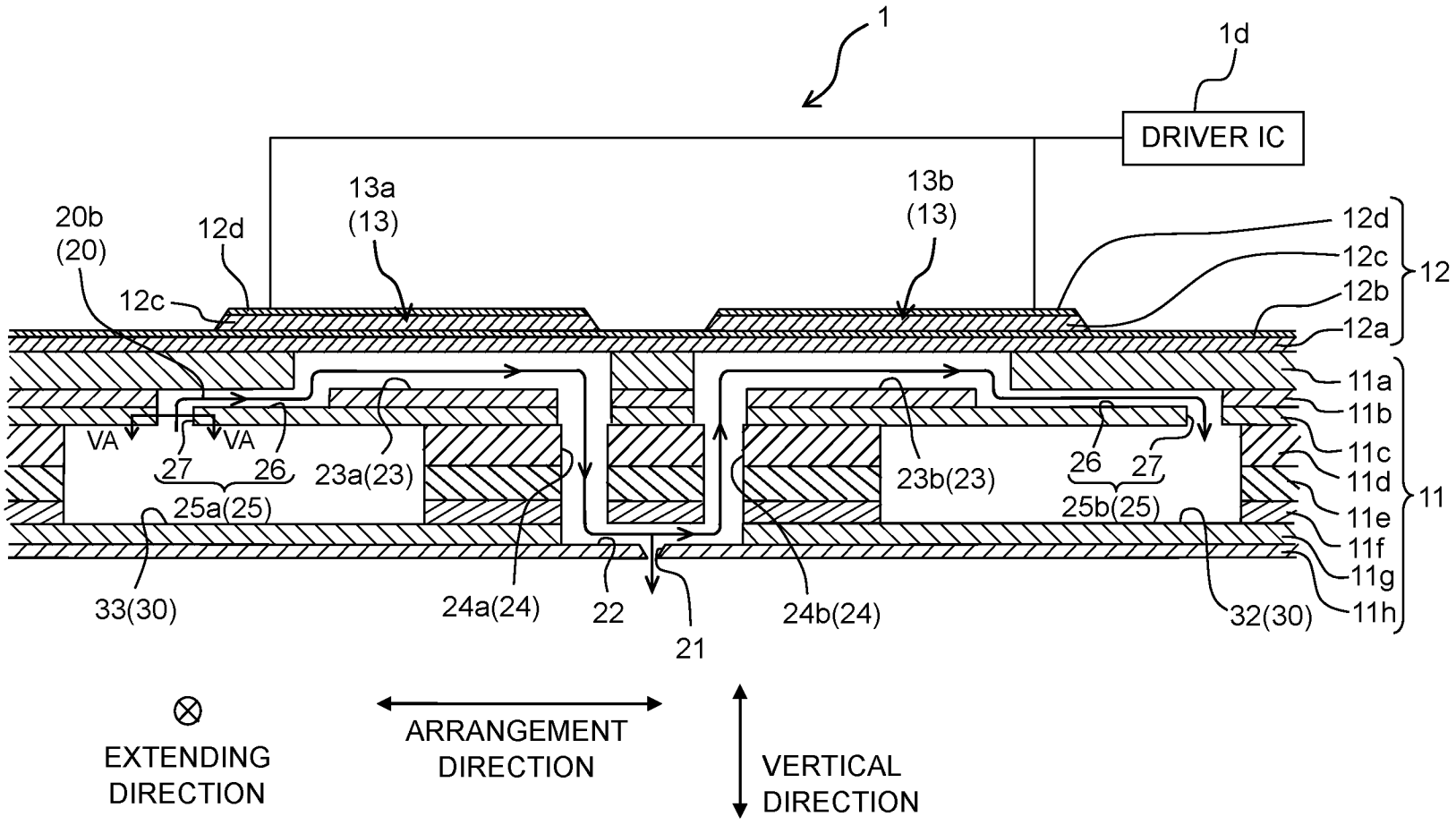
FIG. 3 is a cross-sectional view of the head taken along a line III-III in FIG. 2.

Referring to FIGS. 2 and 3, the configuration of each head 1 is explained below in detail.

The head 1 includes a channel substrate 11 and an actuator unit 12.

As depicted in FIG. 3, the channel substrate 11 is formed by stacking eight plates 11*a* to 11*h* in that order from the top to the bottom. The plates 11*d* to 11*f* are formed having a common channel 30. The plates 11*a* to 11*d* are formed having individual channels 20 communicating with the common channel 30. The common channel 30 and the individual channels 20 are formed by performing etching on the channel substrate 11.

As depicted in FIG. 2, the common channel 30 includes recovery channels 31, 32 and a supply channel 33 arranged or aligned in an arrangement direction (alignment direction) that is parallel to the conveyance direction. The recovery channels 31, 32 and the supply channel 33 extend in an extending direction that is parallel to the sheet width direction). The supply channel 33 is disposed between the recovery channels 31 and 32 in the arrangement direction.

The supply channel 33 extends across the plates 11*a* to 11*f* in the vertical direction at a first end (an upper side of FIG. 2) in the extending direction. An inflow opening 33*x* is provided at an upper end of the supply channel 33. The inflow opening 33*x* is connected to an ink tank 7 via the circulation pump 7*p*. The recovery channels 31 and 32 extend across the plates 11*a* to 11*f* in the vertical direction at a second end (a lower side of FIG. 2) in the extending direction. Outflow openings 31*y* and 32*y* are provided at upper ends of the recovery channels 31 and 32. The outflow openings 31*y* and 32*y* are connected to the ink tank 7.

The ink tank 7 is connected to an ink cartridge (not depicted) via a tube (not depicted) or the like. Ink is supplied from the ink cartridge to the ink tank 7.

Each individual channel 20 includes first individual channels 20*a* each connecting the recovery channel 31 and the supply channel 33, and second individual channels 20*b* each connecting the recovery channel 32 and the supply channel 33. The first individual channels 20*a* are arranged to extend across the recovery channel 31 and the supply channel 33 in the arrangement direction. The second individual channels 20*b* are arranged to extend across the recovery channel 32 and the supply channel 33 in the arrangement direction.

Each individual channel 20 includes the nozzle 21, a communicating path 22, an upstream-side pressure chamber 23*a*, a downstream-side pressure chamber 23*b*, an upstream-side descender channel 24*a*, a downstream-side descender channel 24*b*, an upstream-side throttle channel 25*a*, and a downstream-side throttle channel 25*b*. As depicted in FIG. 3, the nozzle 21 is a through hole formed in the plate 11*h*. The communicating path 22 passes immediately above the nozzle 21. The communicating path 22 is formed in the plate 11*g*. The communicating channel 22 extends in the arrangement direction. The nozzle 21 is connected to a center portion of the communicating path 22. Since the communicating path 22 passes immediately above the nozzle 21, the flow of ink through the communicating path 22 affects a discharge direction (flying direction) of ink discharged from the nozzle 21.

The upstream-side pressure chamber 23*a* is disposed between the communicating path 22 and the supply channel 33. The downstream-side pressure chamber 23*b* is disposed between the communicating path 22 and each of the recovery channels 31, 32. In the following, when there is no need to distinguish the upstream-side pressure chamber 23*a* from the downstream-side pressure chamber 23*b*, the chambers are simply referred to as "pressure chamber(s) 23".

The pressure chamber 23 is a through hole formed in the plate 11*a*. The pressure chamber 23 has a substantially rectangular planar shape of which longitudinal direction is the arrangement direction. Namely, the pressure chamber 23 extends along a plane parallel to the arrangement direction and the extending direction. The plate 11*a* is formed having four pressure chamber rows 23R1 to 23R4. The four pressure chamber rows 23R1 to 23R4 extend in the extending direction and are arranged in the arrangement direction. Of the four pressure chamber rows 23R1 to 23R4, the two pressure chamber rows 23R1 and 23R2 disposed on the left side in FIG. 2 are formed by the upstream-side pressure chambers 23*a* and the downstream-side pressure chambers 23*b* of the first individual channels 20*a*. Of the four pressure chamber rows 23R1 to 23R4, the two pressure chamber rows 23R3 and 23R4 disposed on the right side in FIG. 2 are formed by the upstream-side pressure chambers 23*a* and the downstream-side pressure chambers 23*b* of the second individual channels 20*b*. In each of the pressure chamber rows 23R1 to 23R4, the pressure chambers 23 are arranged in the extending direction at regular intervals so that the pressure chambers 23 are at the same position in the arrangement direction. The pressure chambers 23 belonging to the respective pressure chamber rows 23R1 to 23R4 have mutually different positions in the extending direction. In that configuration, the positions in the extending direction of all the pressure chambers 23 are mutually different from each other.

In this embodiment, all the pressure chambers 23 have the same shape. Thus, all the pressure chamber 23 have the same volume.

The upstream-side descender channel 24*a* connects the upstream-side pressure chamber 23*a* and a first end of the communicating path 22. The downstream-side descender channel 24*b* connects the downstream-side pressure chamber 23*b* and a second end of the communicating path 22. In the following, when there is no need to distinguish the upstream-side descender channel 24*a* from the downstream-side descender channel 24*b*, the channels are simply referred to as "descender channel(s) 24".

The descender channel 24 is formed by overlapping through holes in the plates 11*b* to 11*f* with each other in the vertical direction. More specifically, the upstream-side descender channel 24*a* extends downward from the connection portion with the upstream-side pressure chamber 23*a*. Further, the downstream-side descender channel 24*b* extends downward from the connection portion with the downstream-side pressure chamber 23*b*.

The upstream-side descender channel 24*a* and the downstream-side descender channel 24*b* have the same length. The cross-sectional area of the upstream-side descender channel 24*a* is larger than that of the downstream-side descender channel 24*b*. Thus, the channel resistance of the upstream-side descender channel 24*a* is smaller than that of the downstream-side descender channel 24*b*.

As described above, the nozzle 21 is connected to the center portion of the communicating path 22. In that configuration, the length of a channel (corresponding to an upstream-side connection channel of the present disclosure) ranging from the upstream-side pressure chamber 23*a* to the nozzle 21 via the upstream-side descender channel 24*a* and part of the communicating path 22 is substantially the same as the length of a channel (corresponding to a downstream-side connection channel of the present disclosure) from the downstream-side pressure chamber 23*b* to the nozzle 21 via the downstream-side descender channel 24*b* and part of the communicating path 22.

The upstream-side throttle channel 25*a* connects the supply channel 33 and the upstream-side pressure chamber 23*a*. The downstream-side throttle channel 25*b* connects each of the recovery channels 31, 32 and the downstream-side pressure chamber 23*b*. In the following, when there is no need to distinguish the upstream-side throttle channel 25*a* from the downstream-side throttle channel 25*b*, the channels are simply referred to as "throttle channel(s) 25".

Figure 5A:
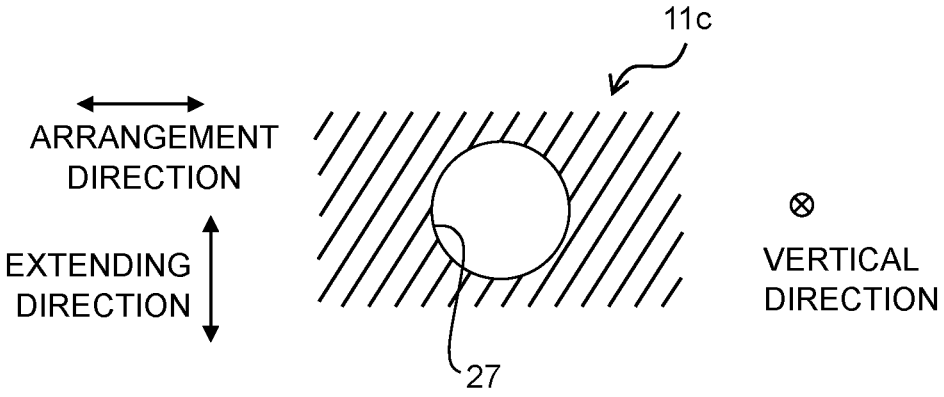
FIG. 5A is a cross-sectional view of the head taken along a line VA-VA in FIG. 3.

The cross-sectional area of the throttle channel 25 is smaller than those of other channels, such as the pressure chambers 23. This allows the throttle channel 25 to have a throttling function by which a pressure wave generated in the pressure chamber 23 is not likely to be transmitted to the supply channel 33 and each of the recovery channels 31, 32. The throttle channel 25 extends over the plates 11*b* and 11*c*. Specifically, the throttle channel 25 includes a horizontal portion 26 formed in the plate 11*b* and a vertical portion 27 formed in the plate 11*c*. The horizontal portion 26 extends in the arrangement direction. A first end in the arrangement direction of the horizontal portion 26 is connected to an end of the pressure chamber 23 on the side opposite to the descender channel 24 in the arrangement direction. The vertical portion 27 extends downward from a second end in the arrangement direction of the horizontal portion 26 and is connected to each of the recovery channels 31, 32 or the supply channel 33. As depicted in FIG. 5A, the cross-section of the vertical portion 27 of the throttle channel 25 has a circular shape.

In this embodiment, the cross-sectional area of the upstream-side throttle channel 25 is the same as the cross-sectional area of the downstream-side throttle channel 25*b*. The channel of the horizontal portion 26 of the upstream-side throttle channel 25*a* is shorter than the channel of the horizontal portion 26 of the downstream-side throttle channel 25*b*. Thus, the upstream-side throttle channel 25*a* is shorter than the downstream-side throttle channel 25*b*. As a result, the channel resistance of the upstream-side throttle channel 25*a* is smaller than that of the downstream-side throttle channel 25*b*. In this embodiment, the channel resistance of the upstream-side throttle channel 25*a* is equal to or more than 60% and equal to or less than 90% of the channel resistance of the downstream-side throttle channel 25*b*.

Subsequently, an ink flow generated when the circulation pump 7*p* is driven is explained. Thick arrows in FIG. 2 and arrows in FIG. 3 indicate ink flows.

As depicted in FIG. 2, when the controller 5 controls and drives the circulation pump 7*p*, the ink in the ink tank 7 flows into the supply channel 33 through the inflow opening 33*x*. The ink is supplied from the supply channel 33 to the respective individual channels 20 (the first individual channels 20*a* and the second individual channels 20*b*).

The ink supplied to each of the individual channels 20 moves almost horizontally while passing through the upstream-side throttle channel 25*a* and the upstream-side pressure chamber 23*a*, moves downward while passing through the upstream-side descender channel 24*a*, and flows into the communicating path 22. The ink flowing into the communicating path 22 moves horizontally while passing through the communicating path 22, and part of the ink is discharged from the nozzle 21. The residual ink moves upward while passing through the downstream-side descender channel 24*b* and moves almost horizontally while passing through the downstream-side pressure chamber 23*b* and the downstream-side throttle channel 25*b*.

The ink supplied to the first individual channel 20*a* is recovered by the recovery channel 31. The ink recovered by the recovery channel 31 flows out of the recovery channel 31 through the outflow opening 31*y*, and is returned to the ink tank 7. The ink supplied to the second individual channel 20*b* is recovered by the recovery channel 32. The ink recovered by the recovery channel 32 flows out of the recovery channel 32 via the outflow opening 32*y*, and is returned to the ink tank 7.

As described above, ink circulates between each head 1 and the ink tank 7. This inhibits the increase in viscosity of the ink in each nozzle 21. In this embodiment, ink always circulates between each head 1 and the ink tank 7. Namely, ink circulates between each head 1 and the ink tank 7 also when the recording processing is being executed.

The actuator unit 12 is disposed on an upper surface of the channel substrate 11 and covers the pressure chambers 23.

As depicted in FIG. 3, the actuator unit 12 includes a vibration plate 12*a*, a common electrode 12*b*, piezoelectric bodies 12*c*, and individual electrodes 12*d* from below in that order. The vibration plate 12*a* and the common electrode 12*b* are disposed on almost the entirety of the upper surface of the channel substrate 11 and cover the pressure chambers 23. Each of the piezoelectric bodies 12*c* and the individual electrodes 12*d* is provided corresponding to one of the piezoelectric chambers 23. Each of the piezoelectric bodies 12*c* and the individual electrodes 12*d* faces one of the piezoelectric chambers 23. The common electrode 12*b* is connected to the driver IC 1*d* and always kept at the ground potential.

In the above configuration, an actuator 13 (see FIG. 3) is formed by one individual electrode 12*d*, an electrode portion of the common electrode 12*b* facing one pressure chamber 23, and a portion of the piezoelectric body 12*c* facing one pressure chamber 23. The actuator unit 12 includes such actuators 13 corresponding to the respective pressure chambers 23.

The driver IC 1*d* (corresponding to a drive apparatus of the present disclosure) applies a predefined drive pulse signal P (see FIGS. 6A and 6B) to the individual electrode 12*d* of each actuator 13 based on a control signal from the controller 5, thus switching the electric potential of the individual electrode 12*d* between a positive electric potential and the ground potential. The drive pulse signal P is a pulse signal having a predefined pulse width and a predefined pulse height (drive voltage V).

In this embodiment, the actuator 13 is driven by so-called pull driving or pull ejection. Specifically, the individual electrode 12*d* is kept at the positive electric potential in advance. The difference in electric potential is generated between the individual electrode 12*d* and the common electrode 12*b* kept at the ground potential, thus causing piezoelectric deformation of the piezoelectric body 12*c* interposed between the individual electrode 12*d* and the common electrode 12*b*. This bends the vibration plate 12*a* and the piezoelectric body 12*c* so that they become convex toward the pressure chamber 23. This makes the pressure chamber 23 a standby state in which the volume of the pressure chamber 23 is reduced.

Then, the drive pulse signal P is applied to the individual electrode 12*d*, causing the individual electrode 12*d* to have the ground potential. This temporarily eliminates the piezoelectric deformation of the piezoelectric body 12*c*. This makes the vibration plate 12*a* and the piezoelectric body 12*c* a horizontal state, making the volume of the pressure chamber 23 larger than that in the standby state. On this occasion, in the upstream-side pressure chamber 23*a*, ink is supplied from the supply channel 33 via the upstream-side throttle channel 25*a*, and in the downstream-side pressure chamber 23*b*, ink is supplied from each of the recovery channels 31 and 32 via the downstream-side throttle channel 25*b*.

After that, the electric potential of the individual electrode 12*d* returns to the positive electric potential, reducing the volume of the pressure chamber 23. This applies pressure to the ink in the pressure chamber 23.

Figure 6A:
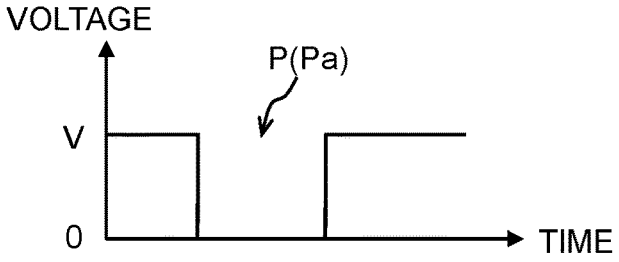
FIG. 6A depicts a drive pulse signal to be applied to an upstream-side actuator.
Figure 6B:
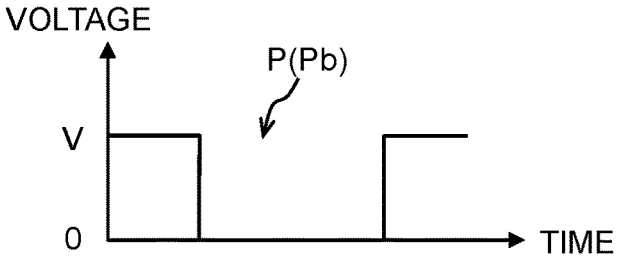
FIG. 6B depicts a drive pulse signal to be applied to a downstream-side actuator.

In this embodiment, as depicted in FIGS. 6A and 6B, a pulse width of the drive pulse signal P (hereinafter, a drive pulse signal Pa) to be applied to the individual electrode 12*d* of the actuator 13 corresponding to the upstream-side pressure chamber 23*a* (hereinafter referred to as an upstream-side actuator 13*a*) is different from a pulse width of the drive pulse signal P (hereinafter, a drive pulse signal Pb) to be applied to the individual electrode 12*d* of the actuator 13 corresponding to the downstream-side pressure chamber 23*b* (hereinafter referred to as an downstream-side actuator 13*b*). Details thereof are explained below. The drive pulse signal Pa and the drive pulse signal Pb have the same pulse height. Namely, the drive voltage when the driver IC 1*d* drives the upstream-side actuator 13*a* is the same as the drive voltage when the driver IC 1*d* drives the downstream-side actuator 13*b*.

When the electrical potential of the individual electrode 12*d* of the upstream-side actuator 13*a* is changed from the positive electric potential to the ground potential and the volume of the upstream-side pressure chamber 23*a* is increased, a negative pressure wave is generated in the upstream-side pressure chamber 23*a*. The negative pressure wave generated in the upstream-side pressure chamber 23*a* is inverted and reflected by a portion near a connection position with the supply channel 33, and thus the negative pressure wave becomes positive. The positive pressure wave travels toward the upstream-side pressure chamber 23*a* (the nozzle 21). When the electric potential of the individual electrode 12*d* is returned to the positive electric potential, the positive pressure wave is generated in the upstream-side pressure chamber 23*a*. The pulse width of the drive pulse signal Pa is set as follows. Namely, the positive pressure wave generated by inverting the negative pressure wave by the portion near the connection position with the supply channel 33 and the positive pressure wave generated when the electric potential of the individual electrode 12*d* is returned to the positive electric potential are superimposed with each other, and the superimposed wave travels toward the nozzle 21. In other words, the pulse width of the drive pulse signal Pa is set depending on a propagation time (hereinafter referred to as an upstream-side propagation time) during which the pressure wave using ink as a medium is propagated from the connection position with the supply channel 33 to the nozzle 21. Namely, the pulse width of the drive pulse signal Pa is set to be longer as the upstream-side propagation time is longer. This allows ink to flow toward the nozzle 21 with greater pressure.

Similarly, the negative pressure wave generated in the downstream-side pressure chamber 23*b* when the electrical potential of the individual electrode 12*d* of the downstream-side actuator 13*b* becomes the ground potential is inverted and reflected by a portion near a connection position with each of the recovery channels 31 and 32, and thus the negative pressure wave becomes positive. The positive pressure wave travels toward the downstream-side pressure chamber 23*b* (the nozzle 21). The pulse width of the drive pulse signal Pb is set as follows. Namely, the positive pressure wave generated by inverting the negative pressure wave by the portion near the connection position with each of the recovery channels 31 and 32 and the positive pressure wave generated when the electric potential of the individual electrode 12*d* is returned to the positive electric potential are superimposed with each other, and the superimposed wave travels toward the nozzle 21. In other words, the pulse width of the drive pulse signal Pb is set depending on a propagation time (hereinafter referred to as an downstream-side propagation time) during which the pressure wave using ink as a medium is propagated from the connection position with each of the recovery channels 31 and 32 to the nozzle 21.

As described above, the upstream-side throttle channel 25*a* is shorter than the downstream-side throttle channel 25*b*. In that configuration, the channel ranging from the connection position with the supply channel 33 to the nozzle 21 is shorter than the channel ranging from the connection position with each of the recovery channel 31 and 32 to the nozzle 21. This makes the upstream-side propagation time shorter than the downstream-side propagation time. The pulse width of the drive pulse signal Pa is thus set to be shorter than the pulse width of the drive pulse signal Pb.

Subsequently, the method of driving the upstream-side actuator 13*a* and the downstream-side actuator 13*b* to discharge ink from the nozzle 21 is explained. The controller 5 discharges ink from the nozzle 21 by driving the upstream-side actuator 13*a* and the downstream-side actuator 13*b* that face two pressure chambers 23 included in the individual channel 20.

Specifically, in order to discharge ink from the nozzle 21, the controller 5 controls the driver IC 1*d* to apply the drive pulse signal Pa to the individual electrode 12*d* of the upstream-side actuator 13*a* so that the upstream-side actuator 13*a* is driven, and controls the driver IC 1*d* to apply the drive pulse signal Pb to the individual electrode 12*d* of the downstream-side actuator 13*b* so that the downstream-side actuator 13*b* is driven.

As described above, the pulse width of the drive pulse signal Pa is shorter than the pulse width of the drive pulse signal Pb. In that configuration, when the driver IC 1*d* is controlled to drive the upstream-side actuator 13*a* and the downstream-side actuator 13*b* simultaneously in order to discharge ink from the nozzle 21, the discharge direction of ink discharged from the nozzle 21 is greatly deviated from the vertical direction (a directly-below direction).

Figure 6C:
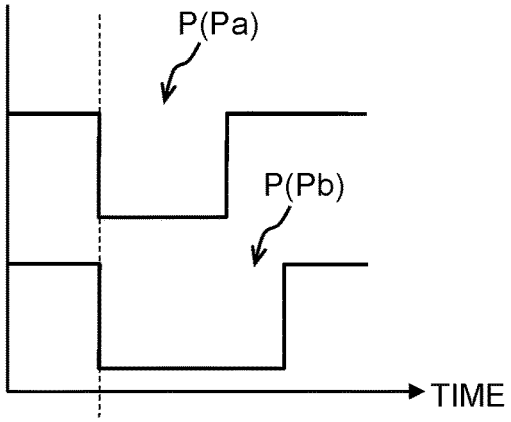
FIG. 6C depicts drive pulse signals in a case that the drive timing of the upstream-side actuator is the same as that of the downstream-side actuator.

More specifically, when the upstream-side actuator 13*a* and the downstream-side actuator 13*b* are driven simultaneously, a starting point of waveform of the drive pulse signal Pa is coincidence with that of the drive pulse signal Pb, as depicted in FIG. 6C. However, since the pulse width of the drive pulse signal Pa is shorter than that of the drive pulse signal Pb, an ending point of waveform of the drive pulse signal Pa is earlier than that of the drive pulse signal Pb. Namely, the timing at which the electric potential of the individual electrode 12*d* is returned to the positive electric potential in the upstream-side actuator 13*a* is earlier than that in the downstream-side actuator 13*b*.

Thus, the timing at which pressure is applied to ink in the upstream-side pressure chamber 23*a* is earlier than the timing at which pressure is applied to ink in the downstream-side pressure chamber 23*b*. This makes the timing at which the pressure wave generated in the upstream-side pressure chamber 23*a* reaches the nozzle 21, earlier than the timing at which the pressure wave generated in the downstream-side pressure chamber 23*b* reaches the nozzle 21. In that case, the timing at which the pressure wave generated in the upstream-side pressure chamber 23*a* reaches the nozzle 21 is different from the timing at which the pressure wave generated in the downstream-side pressure chamber 23*b* reaches the nozzle 21, thus causing the ink discharge direction to greatly deviate from the vertical direction.

Figure 6D:
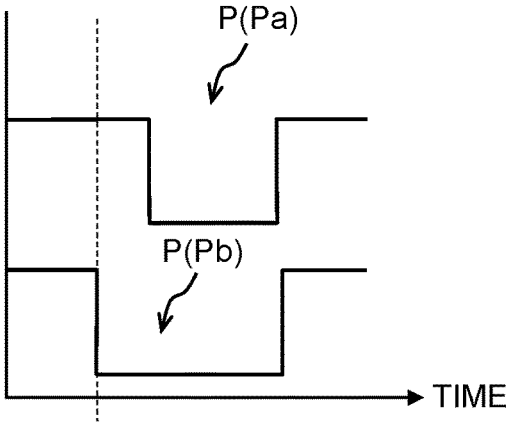
FIG. 6D depicts drive pulse signals in a case that the drive timing of the upstream-side actuator is made later than that of the downstream-side actuator.

In order to solve that problem, when ink is discharged from the nozzle 21 in this embodiment, the controller 5 controls the driver IC 1*d*, as follows. Namely, as depicted in FIG. 6D, the drive timing of the upstream-side actuator 13*a* is set to be later than the drive timing of the downstream-side actuator 13*b* so that the timing at which the pressure wave generated in the upstream-side pressure chamber 23*a* reaches the nozzle 21 is substantially the same as the timing at which the pressure wave generated in the downstream-side pressure chamber 23*b* reaches the nozzle 21. This makes the discharge direction of ink discharged from the nozzle 21 the vertical direction.

Air may enter the individual channel 20 through the nozzle 21 and the like. If air is accumulated in the vicinity of the nozzle 21, the discharge characteristics of the nozzle 21 would be affected thereby. Here, ink may flow from the supply channel 33 to each of the recovery channels 31 and 32 via the individual channel 20 by driving the circulation pump 7*p*. This ink flow discharges the air accumulated in the vicinity of the nozzle 21 to each of the recovery channels 31 and 32. However, if the flow rate of ink is slow in the vicinity of the nozzle 21 in the individual channel 20, the air in the vicinity of the nozzle 21 can not be discharged to each of the recovery channels 31 and 32 effectively.

In this embodiment, the channel resistance of the upstream-side throttle channel 25*a* is set to be smaller than that of the downstream-side throttle channel 25*b*. This makes the channel resistance of the upstream-side throttle channel 25*a* small, thus reducing a pressure loss in the upstream-side throttle channel 25*a*. Further, since the channel resistance of the downstream-side throttle channel 25*b* is large, a differential pressure between the nozzle 21 and a connection position where each of the recovery channels 31 and 32 is connected to the downstream-side throttle channel 25*b* is large. This makes the flow rate of ink in the vicinity of the nozzle 21 fast while keeping the flow amount of ink flowing through the individual channel 20 to some extent. Further, the differential pressure between the nozzle 21 and the connection position where each of the recovery channels 31 and 32 is connected to the downstream-side throttle channel 25*b* is large, and thus the flow rate of ink in the channel ranging from the nozzle 21 to each of the recovery channels 31 and 32 is fast. This allows the air in the vicinity of the nozzle 21 to be discharged to each of the recovery channels 31 and 32 effectively.

In this embodiment, the channel resistance of the upstream-side descender channel 24*a* is smaller than that of the downstream-side descender channel 24*b*. This makes the pressure loss in the upstream-side descender channel 24*a* small and makes the differential pressure between the nozzle 21 and the connection position where each of the recovery channels 31 and 32 is connected to the downstream-side throttle channel 25*b* large. The flow rate of ink in the vicinity of the nozzle 21 is thus fast in this embodiment.

In this embodiment, the cross-section of the vertical portion 27 of the upstream-side throttle channel 25*a* is circular. This makes the pressure loss in the upstream-side throttle channel 25*a* smaller than a case in which all the cross-sections of the upstream-side throttle channel 25*a* are non-circular. The flow rate of ink in the vicinity of the nozzle 21 is thus fast in this embodiment.

In this embodiment, in order to discharge ink from the nozzle 21, the controller 5 controls the driver IC 1*d* so that the drive timing of the upstream-side actuator 13*a* is different from the drive timing of the downstream-side actuator 13*b*. Heat generation in the driver IC 1*d* when the drive timing of the upstream-side actuator 13*a* is different from that of the downstream-side actuator 13*b* is lower than that in the driver IC 1*d* when the drive timing of the upstream-side actuator 13*a* is coincident with that of the downstream-side actuator 13*b*. Detail thereof are explained below.

An electric current flows through the drive IC 1*d* when the actuator 13 is driven. Especially, a large electric current flows through the driver IC 1*d* when the electric potential of the individual electrode 12*d* of the actuator 13 is switched between the positive electric potential and the ground potential. Namely, a large electric current flows through the driver IC 1*d* at the starting point of waveform and the ending point of waveform of the drive pulse signal P. When the drive timing of the upstream-side actuator 13*a* is coincident with the drive timing of the downstream-side actuator 13*b*, the starting point of waveform of the drive pulse signal Pa is coincident with the starting point of waveform of the drive pulse signal Pb. In that case, an excessive electric current flows through the driver IC 1*d* intensively. When the drive timing of the upstream-side actuator 13*a* is different from that of the downstream-side actuator 13*b*, the starting point of waveform of the drive pulse signal Pa is different from the starting point of waveform of the drive pulse signal Pb. In that case, no excessive electric current flows through the driver IC 1*d*. Accordingly, in this embodiment, no excessive electric current flows through the driver IC 1*d* by making the drive timing of the upstream-side actuator 13*a* different from that of the downstream-side actuator 13*b*, thus inhibiting the heat generation in the driver IC 1*d*. In order to inhibit the heat generation in the driver IC 1*d*, the drive timing of the upstream-side actuator 13*a* is preferably different from that of the downstream-side actuator 13*b* so that not only the starting point of waveform of the drive pulse signal Pa is different from that of the drive pulse signal Pb, but also the ending point of waveform of the drive pulse signal Pa is different from that of the drive pulse signal Pb.

Further, in order to discharge ink from the nozzle 21, the controller 5 controls the driver IC 1*d* so that the drive timing of the upstream-side actuator 13*a* is later than the drive timing of the downstream-side actuator 13*b*. This makes the discharge direction of ink from the nozzle 21 the vertical direction.

The channel resistance of the upstream-side throttle channel 25*a* is set to be equal to or more than 60% and equal to or less than 90% of the channel resistance of the downstream-side throttle channel 25*b*. This makes the flow rate of ink in the vicinity of the nozzle 21 fast while maintaining the throttle function of the upstream-side throttle channel 25*a*.

When the channel resistance of the upstream-side throttle channel 25*a* is larger than 90% of the channel resistance of the downstream-side throttle channel 25*b*, the difference between the pulse width of the drive pulse signal Pa and the pulse width of the drive pulse signal Pb is small. As a result, even when the upstream-side actuator 13*a* and the downstream-side actuator 13*b* are driven simultaneously, the discharge direction of ink discharged from the nozzle 21 is not greatly deviated from the vertical direction. Namely, when the controller 5 controls the driver IC 1*d* so that the drive timing of the upstream-side actuator 13*a* is later than that of the downstream-side actuator 13*b*, the discharge direction of ink from the nozzle 21 is more liable to be deviated from the vertical direction, compared to the case where the controller 5 controls the driver IC 1*d* so that the drive timing of the upstream-side actuator 13*a* is the same as that of the downstream-side actuator 13*b*. Thus, when the channel resistance of the upstream-side throttle channel 25*a* is larger than 90% of the channel resistance of the downstream-side throttle channel 25*b*, it may not be possible to make the drive timing of the upstream-side actuator 13*a* different from the drive timing of the downstream-side actuator 13*b*, which makes it difficult to inhibit the heat generation in the driver IC 1*d*.

When the channel resistance of the upstream-side throttle channel 25*a* is not more than 90% of the channel resistance of the downstream-side throttle channel 25*b* like this embodiment, the drive timing of the upstream-side actuator 13*a* is required to be different from the drive timing of the downstream-side actuator 13*b* in order to make the discharge direction of ink from the nozzle 21 the vertical direction. In other words, it is possible to make the drive timing of the upstream-side actuator 13*a* different from the drive timing of the downstream-side actuator 13*b* with the ink discharge direction being the vertical direction. This reliably inhibits the heat generation in the driver IC 1*d*.

In this embodiment, the channel resistance of the upstream-side throttle channel 25*a* is adjusted to be smaller than the channel resistance of the downstream-side throttle channel 25*b* by making the upstream-side throttle channel 25*a* shorter than the downstream-side throttle channel 25*b*. As the method of adjusting the channel resistance of the upstream-side throttle channel 25*a* and the channel resistance of the downstream-side throttle channel 25*b*, a variety of methods can be used instead of the method of making the lengths of the channels different, as in this embodiment. For example, the channel resistance of the upstream-side throttle channel 25*a* can be adjusted to be smaller than the channel resistance of the downstream-side throttle channel 25*b* by making the cross-sectional area of the upstream-side throttle channel 25*a* larger than the cross-sectional area of the downstream-side throttle channel 25*b*. However, in view of etching characteristics, making the lengths of the channels different results in higher adjustment accuracy of the channel resistance than making the cross-sectional areas of the channels different. Details thereof are explained below.

In the etching on the plate, the vicinity of a boundary subjected to etching is not processed into an acute angle, thus generating a gentle slope. Thus, for example, when etching is performed so that an etching width in the extending direction of the horizontal portion 26 of the upstream-side throttle channel 25*a* is different from that of the horizontal portion 26 of the downstream-side throttle channel 25*b*, the cross-section of the horizontal portion 26 of the upstream-side throttle channel 25*a* is not similar to that of the horizontal portion 26 of the downstream-side throttle channel 25*b* due to the gentle slope in the vicinity of the boundary subjected to etching. Namely, when the ratio of the channel resistance of the upstream-side throttle channel 25*a* to the channel resistance of the downstream-side throttle channel 25*b* is made to have a desired value, the gentle slope in the vicinity of the boundary subjected to etching is also required to be included in addition to the etching width in the extending direction of the horizontal portion 26.

When the channel resistance is adjusted by making the length of the upstream-side throttle channel 25*a* different from that of the downstream-side throttle channel 25*b*, the cross-sectional area of the upstream-side throttle channel 25*a* is the same as the cross-sectional area of the downstream-side throttle channel 25*b*. Thus, when the ratio of the channel resistance of the upstream-side throttle channel 25*a* to the channel resistance of the downstream-side throttle channel 25*b* is made to have a desired value, there is no need to include the gentle slope in the vicinity of the boundary subjected to etching.

As described above, in this embodiment, the adjustment accuracy of the channel resistance is enhanced by the method in which the upstream-side throttle channel 25*a* is made shorter than the downstream-side throttle channel 25*b*.

The two pressure chambers 23 including the upstream-side pressure chamber 23*a* and the downstream-side pressure chamber 23*b* may be disposed in a limited space of the head 1. In that case, the upstream-side pressure chamber 23*a* and the downstream-side pressure chamber 23*b* may have the same shape (volume) as in this embodiment. This improves the discharge efficiency of ink compared to a case in which the upstream-side pressure chamber 23*a* and the downstream-side pressure chamber 23*b* have different shapes. Details thereof are explained below. In the following, it is assumed that a total value of volumes of the two pressure chambers 23 when the upstream-side pressure chamber 23*a* and the downstream-side pressure chamber 23*b* have the same shape is equal to a total value of volumes of the two pressure chambers 23 when the upstream-side pressure chamber 23*a* and the downstream-side pressure chamber 23*b* have different shapes.

Figure 5B:
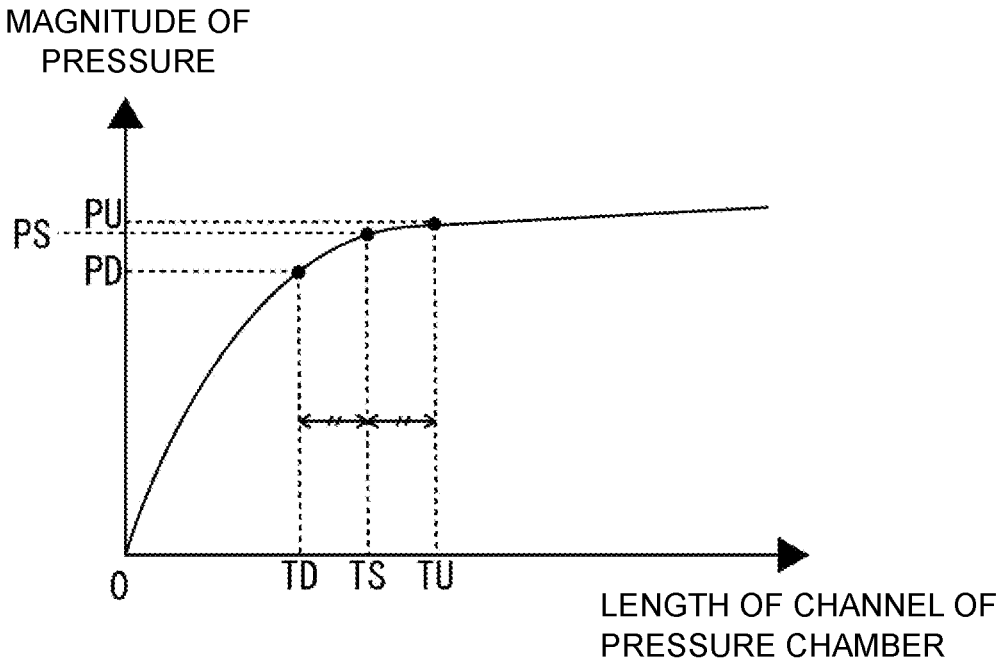
FIG. 5B depicts a relationship between a length of a channel of a pressure chamber and a magnitude of pressure to be applied to the pressure chamber.

As depicted in FIG. 5B, on the assumption that the pressure chamber 23 has the same cross-sectional areas along its longitudinal direction, the pressure to be applied to ink in the pressure chamber 23 when the actuator 13 is driven by applying a certain drive pulse signal P thereto is greater, as the length of the pressure chamber 23 is longer. When the length of the pressure chamber 23 is longer than a predefined length TS, the pressure to be applied to ink in the pressure chamber 23 is almost no different from a pressure value PS when the channel has the length TS. Namely, the pressure to be applied to the ink in the pressure chamber 23 is a curved line that is saturated with the vicinity of the pressure value PS without increasing linearly along with the increase in the length of the pressure chamber 23.

In this embodiment, the upstream-side pressure chamber 23*a* and the downstream-side pressure chamber 23*b* have the length TS. Thus, the pressure to be applied to the ink in the upstream-side pressure chamber 23*a* and the pressure to be applied to the ink in the downstream-side pressure chamber 23*b* each have the pressure value PS.

In order to make the shapes of the two pressure chambers 23 different from each other with the total value of volumes of the two pressure chambers 23 being maintained (with the total value of the lengths of the two pressure chambers 23 being maintained), the length of one of the two pressure chambers 23 is required to have a length TD shorter than the length TS, and the length of the other is required to have a length TU longer than the length TS. In that configuration, the pressure to be applied to the ink in the pressure chamber 23 having the length TD has a pressure value PD smaller than the pressure value PS. The pressure to be applied to the ink in the pressure chamber 23 having the length TU has a pressure value PU greater than the pressure value PS.

As described above, the pressure chamber 23 may have a length exceeding the length TS. In that case, even when the length of the pressure chamber 23 is changed, the magnitude of pressure to be applied to the ink in the pressure chamber 23 is hardly changed. The increase from the pressure value PS to the pressure value PU is thus smaller than the decrease from the pressure value PS to the pressure value PD. Namely, the total value of the pressure value PD and the pressure value PU is smaller than twice the pressure value PS.

Accordingly, the total value of pressure to be applied to the ink in the two pressure chambers 23 when the two pressure chambers 23 have the same length TS and the same shape is larger than that when the two pressure chambers 23 have different shapes. As a result, the discharge energy of ink from the nozzle 21 when the two pressure chambers 23 have the same volume (shape) is larger than that when the two pressure chambers 23 have different shapes, and the discharge efficiency when the two pressure chambers 23 have the same volume (shape) is higher than that when the two pressure chambers 23 have different shapes.

As depicted in FIG. 5B, the two pressure chambers 23 may both have a length not less than the length TS. In that case, even when the lengths are different, the discharge efficiency can be enhanced similarly to the case in which the pressure chambers 23 have the same shape. However, it is difficult to allow the upstream-side pressure chamber 23*a* and the downstream-side pressure chamber 23*b* to have a length of not less than the length TS in the limited space of the head 1.

In this embodiment, the upstream-side pressure chamber 23*a* and the downstream-side chamber 23*b* have the same shape so that they can be disposed in the limited space of the head 1. This improves the discharge efficiency.

The wording "the upstream-side pressure chamber 23*a* and the downstream-side chamber 23*b* have the same shape" means not only that the shape of the upstream-side pressure chamber 23*a* is exactly the same as that of the downstream-side chamber 23*b*, but also that they have substantially the same shape so that discharge efficiency of not less than a predefined threshold value is provided (i.e., the shape of upstream-side pressure chamber 23*a* is not exactly the same as that of the downstream-side chamber 23*b*).

In this embodiment, the drive voltage generated when the driver IC 1*d* drives the upstream-side actuator 13*a* is the same as the drive voltage generated when the driver IC 1*d* drives the downstream-side actuator 13*b*. This simplifies the drive control for the upstream-side actuator 13*a* and the downstream-side actuator 13*b* performed by the driver IC 1*d*, compared to a case in which the upstream-side actuator 13*a* is different in drive voltage from the downstream-side actuator 13*b*. This downsizes the driver IC 1*d* and reduces costs of the driver IC 1*d*.

The embodiment of the present disclosure is explained above. The present disclosure, however, is not limited to the above embodiment. Various changes or modifications may be made without departing from the claims. For example, in the above embodiment, the channel resistance of the upstream-side throttle channel 25*a* is made to be smaller than the channel resistance of the downstream-side throttle channel 25*b* by making the upstream-side throttle channel 25*a* shorter than the downstream-side throttle channel 25*b*. The present disclosure, however, is not limited thereto. For example, the channel resistance of the upstream-side throttle channel may be made to be smaller than the channel resistance of the downstream-side throttle channel by making the cross-sectional area of the upstream-side throttle channel larger than the cross-sectional area of the downstream-side throttle channel.

All the cross-sections of the upstream-side throttle channels may be circular. This further reduces the pressure loss in the upstream-side throttle channel. Or, although the pressure loss in the upstream-side throttle channel is larger than that in the above embodiment, the cross-section(s) of the upstream-side throttle channel(s) may be non-circular.

In the above embodiment, the channel resistance of the upstream-side descender channel 24*a* is made to be smaller than the channel resistance of the downstream-side descender channel 24*b*. The present disclosure, however, is not limited thereto. The channel resistance of the upstream-side descender channel 24*a* may be equal to the channel resistance of the downstream-side descender channel 24*b*.

In the above embodiment, in order to discharge ink from the nozzle 21, the controller 5 controls the driver IC 1*d* so that the drive timing of the upstream-side actuator 13*a* is later than the drive timing of the downstream-side actuator 13*b*. The present disclosure, however, is not limited thereto. For example, when there is no need to make the ink discharge direction the vertical direction, the controller 5 may control the driver IC so that the drive timing of the upstream-side actuator is earlier than the drive timing of the downstream-side actuator. Also in that configuration, since the drive timing of the upstream-side actuator is different from the drive timing of the downstream-side actuator, it is possible to inhibit the heat generation in the driver IC. For example, when the channel resistance of the upstream-side throttle channel is larger than 90% of the channel resistance of the downstream-side throttle channel, the controller may control the driver IC so that the drive timing of the upstream-side actuator is the same as the drive timing of the downstream-side actuator, in order to discharge ink from the nozzle.

In the above embodiment, the upstream-side pressure chamber 23*a* and the downstream-side chamber 23*b* have the same shape in the above embodiment. The present disclosure, however, is not limited thereto. For example, the upstream-side pressure chamber and the downstream-side chamber may have different shapes while having the same volume. In that case, although the discharge efficiency is lower than the case in which the upstream-side pressure chamber and the downstream-side chamber have the same shape, the discharge efficiency is higher than the case in which the upstream-side pressure chamber and the downstream-side chamber have different volumes. The wording "the upstream-side pressure chamber and the downstream-side chamber have the same volume" means not only that the volume of upstream-side pressure chamber is exactly the same as that of the downstream-side chamber, but also that they have substantially the same volume so that discharge efficiency of not less than a predefined threshold value is provided (i.e., the volume of upstream-side pressure chamber is not exactly the same as that of the downstream-side chamber). For example, if there is an error of approximately 10% between the volume of the upstream-side pressure chamber and the volume of the downstream-side pressure chamber, it is considered that the upstream-side pressure chamber and the downstream-side chamber have the same volume. Although the discharge efficiency is not good, the upstream-side pressure chamber and the downstream-side pressure chamber may have different volumes and shapes.

The drive voltage generated when the driver IC drives the upstream-side actuator may be different from the drive voltage generated when the driver IC drives the downstream-side actuator. For example, the upstream-side pressure chamber and the downstream-side pressure chamber may have different shapes and volumes. In that case, the drive voltage for driving the actuator that applies pressure to ink in the pressure chamber having a smaller volume may be higher than the drive voltage for driving the actuator that applies pressure to ink in the pressure chamber having a larger volume.

In the above embodiment, ink circulates between the head 1 and the ink tank 7. However, ink may not circulate therebetween, provided that ink flows from the supply channel to the recovery channel via the individual channels. In that case, a tank for accumulating air is preferably connected to the recovery channel to enhance the recovery efficiency of air flowing into the recovery channel through the individual channels.

In the above embodiment, the driver IC 1*d* drives the actuator 13 using pull driving or pull ejection. The present disclosure, however, is not limited thereto. The driver IC 1*d* may drive an actuator using so-called push driving in which ink is discharged by reducing the volume of the pressure chamber in the standby state and generating the positive pressure wave.

The examples in which the present disclosure is applied to the printer including the line head are explained above. The present disclosure, however, is not limited thereto. The present disclosure is applicable to a printer including a so-called serial head that is carried on a carriage moving in a scanning direction and discharges ink from nozzles while moving in the scanning direction together with the carriage.

The examples in which the present disclosure is applied to the printer that discharges ink from nozzles to perform recording on a recording sheet are explained above. The present disclosure, however, is not limited thereto. The present disclosure is applicable to a liquid discharge head discharging any other liquid than ink, such as liquefied resin and liquefied metal.

What is claimed is:

1. A liquid discharge head, comprising:

a plurality of individual channels;

a supply channel connected to inlets of the individual channels and through which liquid is supplied to the individual channels;

a recovery channel connected to outlets of the individual channels and through which the liquid is recovered from the individual channels, wherein each of the individual channels includes:

a nozzle;

an upstream-side pressure chamber disposed between the nozzle and the supply channel;

a downstream-side pressure chamber disposed between the nozzle and the recovery channel;

an upstream-side throttle channel connecting the supply channel and the upstream-side pressure chamber; and a downstream-side throttle channel connecting the recovery channel and the downstream-side pressure chamber, the liquid discharge head further comprising:

an upstream-side actuator configured to apply pressure to the liquid in the upstream-side pressure chamber; and a downstream-side actuator configured to apply pressure to the liquid in the downstream-side pressure chamber, wherein a channel resistance of the upstream-side throttle channel is smaller than a channel resistance of the downstream-side throttle channel.

2. The liquid discharge head according to claim 1, wherein the upstream-side throttle channel is shorter than the downstream-side throttle channel.

3. The liquid discharge head according to claim 1, wherein each of the individual channels further includes an upstream-side connection channel connecting the upstream-side pressure chamber and the nozzle and a downstream-side connection channel connecting the downstream-side pressure chamber and the nozzle, and a channel resistance of the upstream-side connection channel is smaller than a channel resistance of the downstream-side connection channel.

4. The liquid discharge head according to claim 1, wherein a cross-section of at least part of the upstream-side throttle channel is a circular shape.

5. The liquid discharge head according to claim 1, wherein a volume of the upstream-side pressure chamber is identical to a volume of the downstream-side pressure chamber.

6. The liquid discharge head according to claim 1, wherein the channel resistance of the upstream-side throttle channel is equal to or more than 60% and equal to or less than 90% of the channel resistance of the downstream-side throttle channel.

7. The liquid discharge head according to claim 1, further comprising a driver configured to drive the upstream-side actuator and the downstream-side actuator, wherein a drive voltage of the driver for driving the upstream-side actuator is identical to a drive voltage of the driver for driving the downstream-side actuator.

8. A liquid discharge apparatus comprising:

the liquid discharge head as defined in claim 1; and a controller configured to control the liquid discharge head, wherein the liquid discharge head further includes a driver configured to drive the upstream-side actuator and the downstream-side actuator, wherein the controller is configured to control the driver so that a drive timing of the upstream-side actuator is different from a drive timing of the downstream-side actuator in a case that the liquid is discharged from the nozzle.

9. The liquid discharge apparatus according to claim 8, wherein the controller is configured to control the driver so that the drive timing of the upstream-side actuator is later than the drive timing of the downstream-side actuator in the case that the liquid is discharged from the nozzle.

* * * * *